US010674251B2

(12) United States Patent
Oishi

(10) Patent No.: US 10,674,251 B2
(45) Date of Patent: Jun. 2, 2020

(54) NOISE REDUCTION FOR HIGH-AIRFLOW AUDIO TRANSDUCERS

(71) Applicant: Sonos, Inc., Santa Barbara, CA (US)

(72) Inventor: Tetsuro Oishi, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 55 days.

(21) Appl. No.: 16/145,781

(22) Filed: Sep. 28, 2018

(65) Prior Publication Data

US 2019/0037305 A1 Jan. 31, 2019

Related U.S. Application Data

(63) Continuation of application No. 15/421,047, filed on Jan. 31, 2017, now Pat. No. 10,142,726.

(51) Int. Cl.
*H04R 1/02* (2006.01)
*H04R 1/28* (2006.01)
(Continued)

(52) U.S. Cl.
CPC ..... *H04R 1/2849* (2013.01); *H04R 1/023* (2013.01); *H04R 1/2819* (2013.01);
(Continued)

(58) Field of Classification Search
CPC ..... H04R 1/02; H04R 1/023; H04R 1/2819; H04R 1/2846; H04R 1/2849; H04R 1/2873; H04R 5/02; H04R 2499/11; H04M 1/035
(Continued)

(56) References Cited

U.S. PATENT DOCUMENTS 5,440,644 A 8/1995 Farinelli et al.
5,502,772 A * 3/1996 Felder ..... H04R 1/20 181/199
(Continued)

FOREIGN PATENT DOCUMENTS

EP 1389853 A1 2/2004
WO 200153994 7/2001
WO 2003093950 A2 11/2003

OTHER PUBLICATIONS

AudioTron Quick Start Guide, Version 1.0, Mar. 2001, 24 pages.
(Continued)

*Primary Examiner* — Huyen D Le
(74) *Attorney, Agent, or Firm* — McDonnell Boehnen Hulbert & Berghoff LLP

(57) ABSTRACT

Example techniques may involve reduction of turbulence noise from a sound transducer that is mounted within an interior housing of a playback device. An example playback device may include an enclosure comprising a first interior volume and a second interior volume. The playback device may further include a speaker mounted within an interior of the enclosure. The speaker includes a diaphragm dividing the first interior volume and the second interior volume and the speaker is moveable along an axis to generate sound. The playback device may also include a first speaker vent providing airflow between the first interior volume and an exterior of the enclosure and a second speaker vent providing airflow between the first interior volume and the exterior of the enclosure. The first speaker vent directs airflow in a first direction and second speaker vent directs airflow in a second direction.

20 Claims, 8 Drawing Sheets

(51) Int. Cl.
*H04R 1/34* (2006.01)
*H04R 1/40* (2006.01)
*H04R 5/02* (2006.01)

(52) U.S. Cl.
CPC ..... *H04R 1/2846* (2013.01); *H04R 1/2873* (2013.01); *H04R 1/345* (2013.01); *H04R 1/403* (2013.01); *H04R 5/02* (2013.01); *H04R 2499/11* (2013.01)

(58) Field of Classification Search
USPC ..... 381/334, 335, 338, 345, 349, 350, 351, 381/352, 182, 186, 386; 181/144, 145, 181/147, 156, 199
See application file for complete search history.

(56) References Cited

U.S. PATENT DOCUMENTS 5,524,062 A * 6/1996 Oh ..... H04R 1/2842 381/338
5,546,468 A * 8/1996 Beard ..... B60R 11/0217 181/145
5,657,392 A 8/1997 Bouchard
5,761,320 A 6/1998 Farinelli et al.
5,790,679 A 8/1998 Hawker et al.
5,825,900 A 10/1998 Jeon
5,923,902 A 7/1999 Inagaki
6,032,202 A 2/2000 Lea et al.
6,144,738 A * 11/2000 Hawker ..... H04M 1/03 379/433.02
6,256,554 B1 7/2001 DiLorenzo
6,404,811 B1 6/2002 Cvetko et al.
6,469,633 B1 10/2002 Wachter et al.
6,522,886 B1 2/2003 Youngs et al.
6,611,537 B1 8/2003 Edens et al.
6,631,410 B1 10/2003 Kowalski et al.
6,757,517 B2 6/2004 Chang et al.
6,778,869 B2 8/2004 Champion
7,130,608 B2 10/2006 Hollstrom et al.
7,130,616 B2 10/2006 Janik
7,143,939 B2 12/2006 Henzerling
7,236,773 B2 6/2007 Thomas
7,295,548 B2 11/2007 Blank et al.
7,391,791 B2 6/2008 Balassanian et al.
7,483,538 B2 1/2009 McCarty et al.
7,571,014 B1 8/2009 Lambourne et al.
7,630,501 B2 12/2009 Blank et al.
7,643,894 B2 1/2010 Braithwaite et al.
7,657,910 B1 2/2010 McAulay et al.
7,764,806 B2 7/2010 Pei et al.
7,853,341 B2 12/2010 McCarty et al.
7,987,294 B2 7/2011 Bryce et al.
8,014,423 B2 9/2011 Thaler et al.
8,045,952 B2 10/2011 Qureshey et al.
8,103,009 B2 1/2012 McCarty et al.
8,234,395 B2 7/2012 Millington et al.
8,483,853 B1 7/2013 Lambourne et al.
8,942,252 B2 1/2015 Balassanian et al.
2001/0042107 A1 11/2001 Palm
2002/0022453 A1 2/2002 Balog et al.
2002/0026442 A1 2/2002 Lipscomb et al.
2002/0124097 A1 9/2002 Isely et al.
2003/0157951 A1 8/2003 Hasty
2004/0024478 A1 2/2004 Hans et al.
2007/0142944 A1 6/2007 Goldberg et al.

OTHER PUBLICATIONS

AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Non-Final Office Action dated Mar. 29, 2018, issued in connection with U.S. Appl. No. 15/421,047, filed Jan. 31, 2017, 13 pages.
Notice of Allowance dated Aug. 6, 2018, issued in connection with U.S. Appl. No. 15/421,047, filed Jan. 31, 2017, 5 pages.
Palm, Inc., "Handbook for the Palm VII Handheld," May 2000, 311 pages.
Presentations at WinHEC 2000, May 2000, 138 pages.
United States Patent and Trademark Office, U.S. Appl. No. 60/490,768 filed Jul. 28, 2003, entitled "Method for synchronizing audio playback between multiple networked devices," 13 pages.
United States Patent and Trademark Office, U.S. Appl. No. 60/825,407 filed on Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

NOISE REDUCTION FOR HIGH-AIRFLOW AUDIO TRANSDUCERS

CROSS REFERENCE TO RELATED APPLICATIONS

This application claims priority under 35 U.S.C. § 120 to, and is a continuation of, U.S. non-provisional patent application Ser. No. 15/421,047, filed on Jan. 31, 2017 entitled "Noise Reduction for High-Airflow Audio Transducers," which is incorporated herein by reference in its entirety.

FIELD OF THE DISCLOSURE

The disclosure is related to consumer goods and, more particularly, to methods, systems, products, features, services, and other elements directed to media playback or some aspect thereof.

BACKGROUND

Options for accessing and listening to digital audio in an out-loud setting were limited until in 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
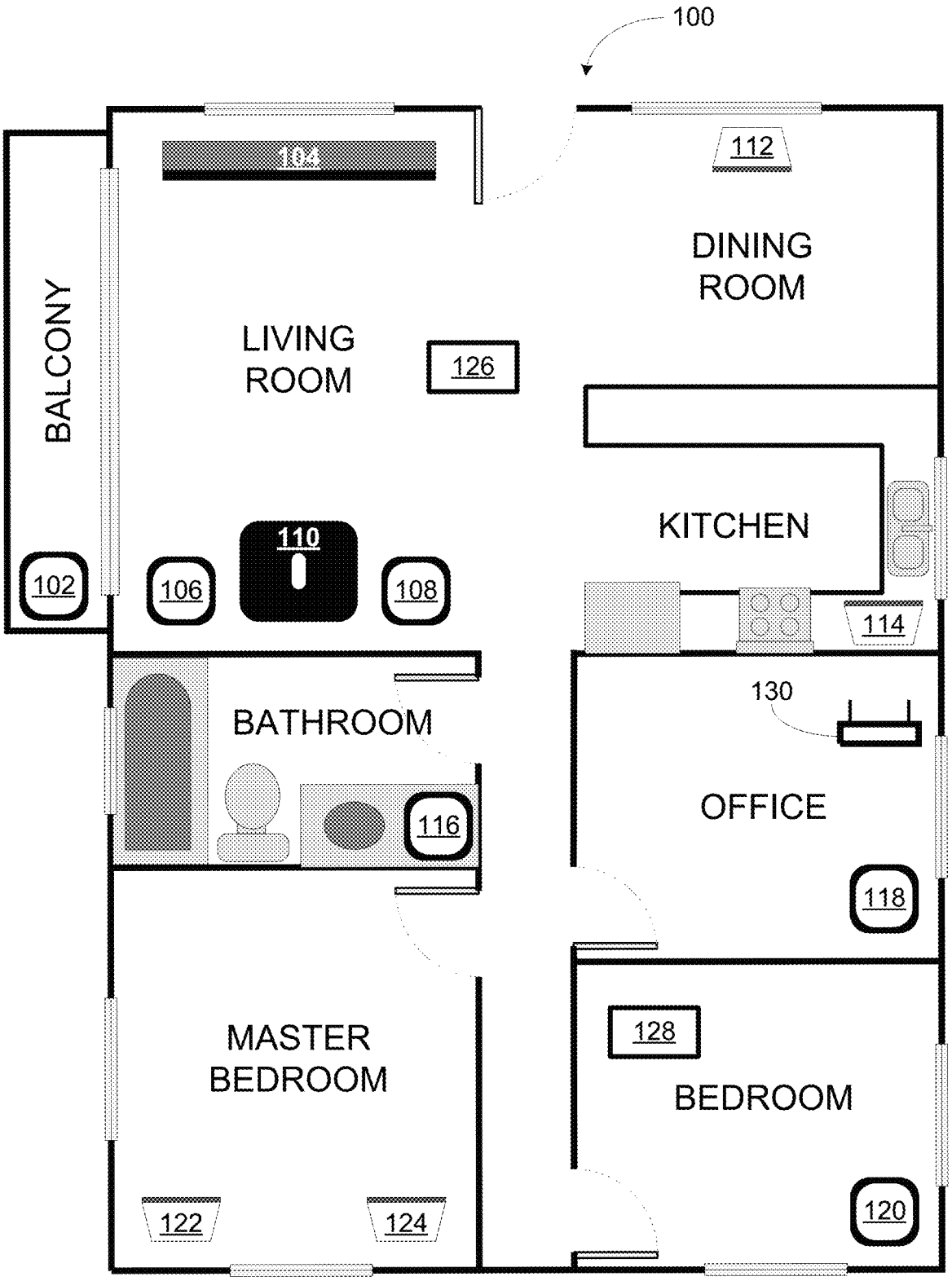
FIG. 1 shows an example media playback system configuration in which certain embodiments may be practiced.

The drawings are for the purpose of illustrating example embodiments, but it is understood that the inventions are not limited to the arrangements and instrumentality shown in the drawings.

DETAILED DESCRIPTION

I. Overview

Some audio drivers, such as woofers, are designed for reproduction of low-frequency (e.g., bass) audio. To reproduce bass frequencies at sufficient volume, woofers often have diaphragms with relatively large surface areas as compared with other audio transducers that are designed to reproduce higher frequency audio, such as tweeters. In operation, such drivers generate significant airflow while producing their intended response (i.e., sound that includes low-frequency output). Moreover, as volume increases, audio drivers generate greater airflow. Airflow generated by an audio driver may be referred to as its "exhaust."

If the exhaust of an audio driver encounters material, such as a speaker grill or vent, turbulence may result. In some cases, this turbulence may produce audible noise, which may interfere with enjoyment of audio output from the transducer. As such, in some cases, speakers or playback devices having woofers or similar audio drivers are designed to avoid turbulence (and associated noise) by having their woofer(s) directed at the expected listener location with minimal obstruction (i.e., little, if any, grille or vents). Moreover, some types of audio drivers, such as tweeters and mid-range drivers, are relatively directional, so orienting such drivers at the expected listener location may improve response of the drivers as heard from those locations.

As a result, audio drivers of a playback device or speaker are in some cases mounted on the front of an enclosure to direct audio output into the listening area (i.e., at the assumed locations of listeners). This configuration may limit the possible geometries of the enclosure. In particular, in such configurations, the front of the enclosure has at least as much surface area as the transducer(s) mounted on the face. For example, a playback device having a round audio driver with a 5" diameter might have a front side that is at least as large as the audio driver area.

Example implementations described herein involve an audio transducer (e.g., a woofer) that is mounted within an interior of an enclosure. Such configurations expand the possible geometries of a housing for that speaker, as the transducer may be oriented in a direction other than that of the listener(s). For instance, the transducer may be mounted vertically within a housing such its exhaust is directed upwards and downwards into interior volumes within that housing. With a vertical orientation, the housing may be shorter than either the length or the width of the transducer (and instead be at least as tall as the depth of the transducer).

As compared with tweeters and mid-range drivers, woofers are relatively omni-directional. As such, orienting a woofer in a direction other than that of the listener does not have as much of an effect on the response perceived by listeners as would re-directing tweeter and mid-range drivers. Moreover, woofers are physically larger than tweeters and mid-range drivers so being able to re-direct the larger audio driver(s) of a device opens up relatively more possible geometries for that device.

In some particular implementations, an example playback device may be a "sound base" that is intended to be paired with a television (e.g., a flat-panel LCD HDTV) or other display device to provide sound output for that device. The sound base may provide at least some of the sound output via one or more transducers (e.g., a woofer) mounted with an interior volume of its enclosure. In some implementations, other audio transducers (e.g., tweeters and/or mid-range drivers) may be mounted on the exterior of the enclosure. Mounting relatively large transducers (e.g., woofers) within the interior volume in a vertical orientation allows the sound base to have a relatively low-profile housing.

In addition to a relatively low-profile, a housing of a sound base may have a sturdy top surface. Such a housing may be utilized with commercially-available televisions having a single central stand or support legs toward each edge of the display device, among other possible configurations. With a display device having a single central stand, the central stand may rest upon and be supported by the sturdy top surface. Alternatively, the sound base may fit within open space under the display device created by support legs near each edge of the display device.

However, mounting the audio driver within an enclosure interior produces exhaust within that volume. As such, example implementations may include one or more vents, ports, horns ducts, and/or other openings from the interior volume to facilitate airflow from the interior volume to the exterior of the housing. Such openings, generally referred to hereafter as "vents," may re-direct exhaust from the audio driver. For instance, with the example sound base noted above, such vents may re-direct exhaust from a vertically-oriented transducer out the sides of the housing, as the top and bottom of the housing may be partially or fully obscured during use by the display device or the support surface (e.g., a media console), respectively.

Directing speaker exhaust through such vents creates turbulence and noise. The magnitude of this turbulence—and the loudness of associated noise—can be reduced by reducing air velocity. Increasing the cross-sectional area of the vents reduces air velocity. However, certain playback devices (e.g., a sound base) may have particular geometries (e.g., a low-profile housing) and/or other components (e.g., tweeters) that constrain the cross-sectional area of the vents.

To increase the total cross-sectional area of the vents (and thereby reduce noise from turbulence), multiple vents may be used for each transducer. For instance, an example sound base may have an interior woofer mounted vertically with two (or more vents) redirecting exhaust from the front of the speaker out one or more sides of the housing. A port or other opening may facilitate airflow from the rear of the interior woofer to the exterior of the housing.

In some examples, the two (or more vents) may redirect speaker exhaust in two or more directions. By directing speaker exhaust in two or more directions using respective vents, associated noise from turbulence in each direction is reduced. The noise from turbulence in each direction is proportional to the air velocity in that direction. By controlling the ratio of airspeed through each vent, the majority of the speaker exhaust (and associated noise) can be directed away to the side in an attempt to direct the exhaust away from listeners.

For instance, an example sound base may include a first vent and a second vent for an internal woofer. The first vent may have a smaller cross section but be directed out of the side of the housing to direct higher velocity exhaust (and associated noise from turbulence) away from listeners, assuming that they are in front of the playback device). A second vent with a relatively larger cross section area may direct some of the exhaust out a front face of the housing. Although this exhaust is directed into the room at expected listener positions, the air velocity from this exhaust is reduced by the presence of the first vent. By balancing the respective air flows through the vents, each vent can handle a respective portion of the speaker exhaust, thereby reducing the overall perceptibility of the noise from turbulence.

As noted above, example techniques may involve reduction of turbulence noise from a sound transducer that is mounted within an interior housing of a playback device. An example implementation may include an enclosure comprising a first interior volume and a second interior volume. The implementation may further include a speaker mounted within an interior of the enclosure. The speaker includes a diaphragm dividing the first interior volume and the second interior volume and the speaker is moveable along a vertical axis to generate sound. The implementation may also include a first speaker vent providing airflow between the first interior volume and an exterior of the enclosure and a second speaker vent providing airflow between the first interior volume and the exterior of the enclosure. The first speaker vent directs airflow in a first horizontal direction and second speaker vent directs airflow in a second horizontal direction.

Another example implementation may include an enclosure comprising a first interior volume and a second interior volume. The implementation may further include a speaker mounted within an interior of the enclosure. The speaker includes a diaphragm dividing the first interior volume and the second interior volume and the speaker is moveable along an axis to generate sound. The implementation also includes a first speaker vent providing airflow between the first interior volume and an exterior of the enclosure and a second speaker vent providing airflow between the first interior volume and the exterior of the enclosure. The first speaker vent directs airflow in a first direction that is substantially perpendicular to the axis and the second speaker vent directs airflow in a second direction that is substantially perpendicular to the axis.

Another example implementation may involve providing an enclosure comprising a first interior volume and a second interior volume. The implementation may also involve mounting a speaker within an interior of the enclosure. The speaker includes a diaphragm dividing the first interior volume and the second interior volume and the speaker is moveable along an axis to generate sound. The implementation may further include forming a first speaker vent providing airflow between the first interior volume and an exterior of the enclosure and a second speaker vent providing airflow between the first interior volume and the exterior of the enclosure. The first speaker vent directs airflow in a first direction that is substantially perpendicular to the axis and the second speaker vent directs airflow in a second direction that is substantially perpendicular to the axis.

Each of these example implementations may be embodied as a playback device or features thereof, a method for assembling a playback device or features thereof, or a system of devices configured to carry out the implementation, among other examples. It will be understood by one of ordinary skill in the art that this disclosure includes numerous other embodiments, including combinations of the example features described herein. Further, any example operation described as being performed by a given device to illustrate a technique may be performed by any suitable devices, including the devices described herein. Yet further, any device may cause another device to perform any of the operations described herein.

While some examples described herein may refer to the presence of and/or functions performed by given actors such as "users," "listeners" and/or other entities, it should be understood that this description is for purposes of explanation only. The claims should not be interpreted to require action by or the presence of any such example actor unless explicitly required by the language of the claims themselves.

II. Example Operating Environment

FIG. 1 illustrates an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102, 104, 106, 108, 110, 112, 114, 116, 118, 120, 122, 124, control devices 126 and 128, a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
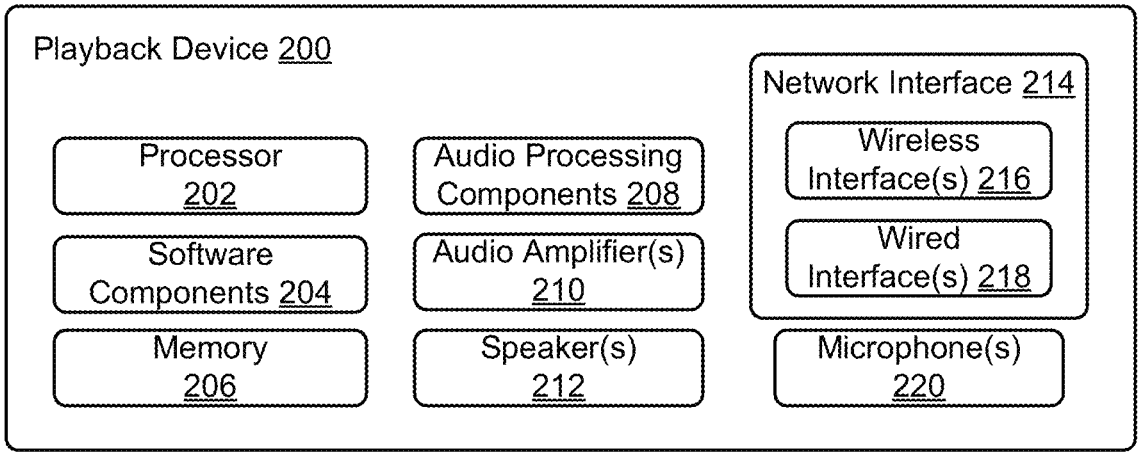
FIG. 2 shows a functional block diagram of an example playback device.

FIG. 2 shows a functional block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, and a network interface 214 including wireless interface(s) 216 and wired interface(s) 218. In one case, the playback device 200 may not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The audio processing components 208 and the audio amplifier(s) 210 may be referred to as an audio stage.

The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection) or the network interface 214.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being playing by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
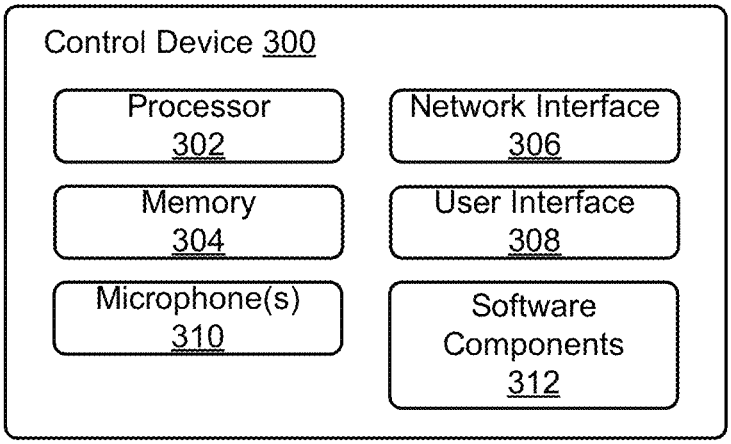
FIG. 3 shows a functional block diagram of an example control device.

FIG. 3 shows a functional block diagram of an example control device 300 that may be configured to be one or both of the control devices 126 and 128 of the media playback system 100. Control device 300 may also be referred to as a controller 300. As shown, the control device 300 may include a processor 302, memory 304, a network interface 306, and a user interface 308. In one example, the control device 300 may be a dedicated controller for the media playback system 100. In another example, the control device 300 may be a network device on which media playback system controller application software may be installed, such as for example, an iPhone™ iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be configured to store instructions executable by the processor 302 to perform those functions. The memory 304 may also be configured to store the media playback system controller application software and other data associated with the media playback system 100 and the user.

In one example, the network interface 306 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

Figure 4:
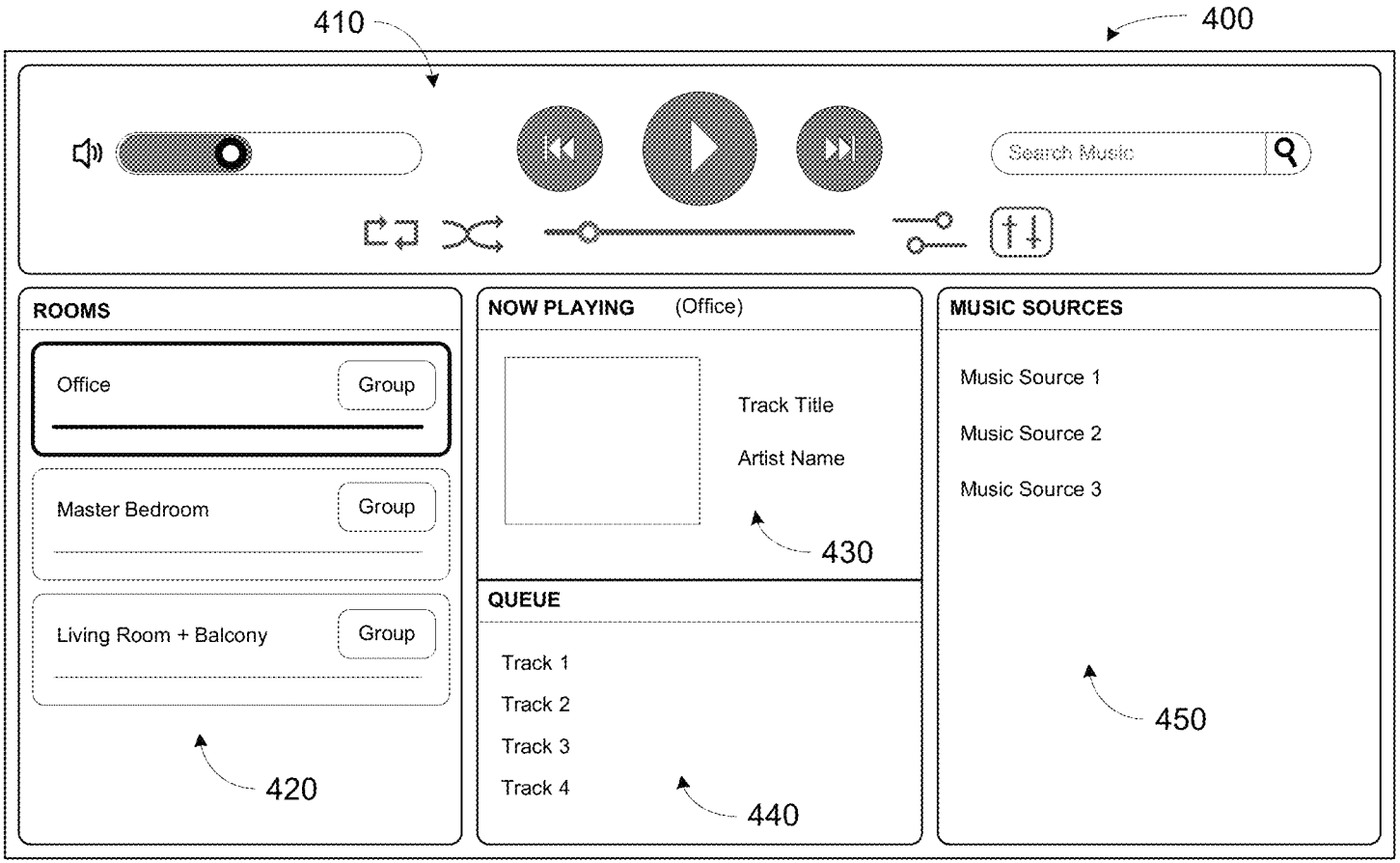
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The controller interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the controller interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the controller interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the user interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device. Playback of such a playback queue may involve one or more playback devices playing back media items of the queue, perhaps in sequential or random order.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g., according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

III. Example Implementations

Figure 5A:
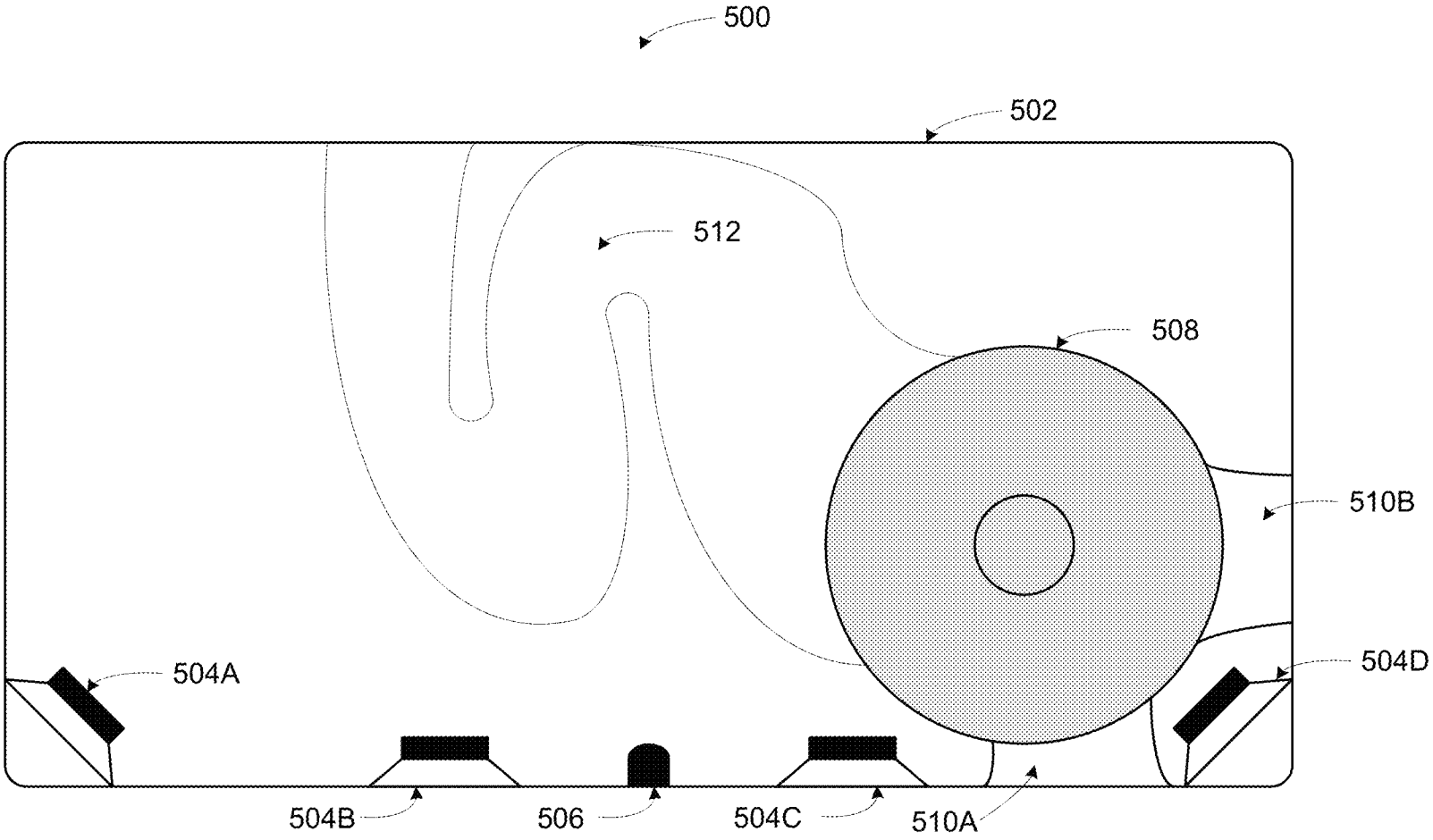
FIG. 5A shows a first view of an example playback device, according to example implementations.
Figure 5B:
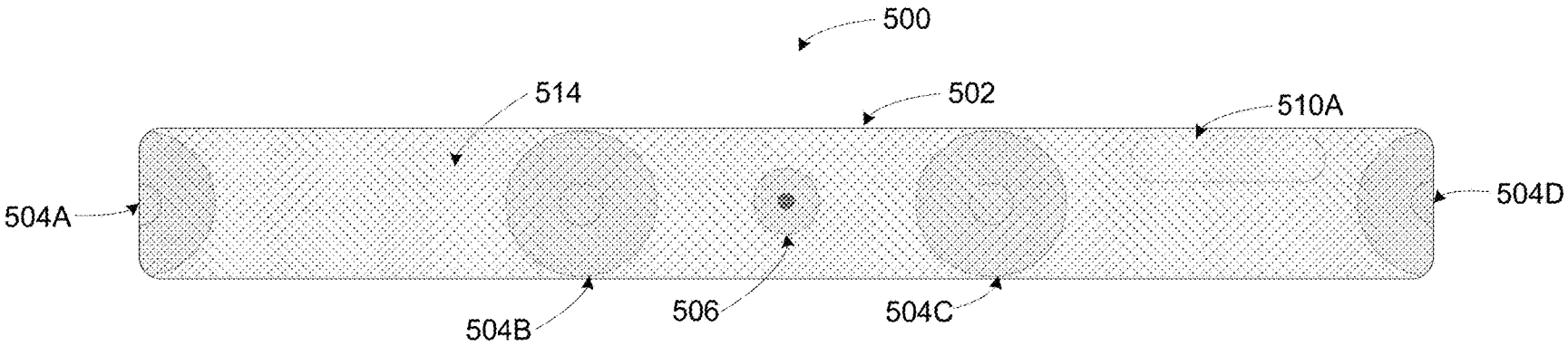
FIG. 5B shows a second view of the example playback device, according to example implementations.
Figure 5C:
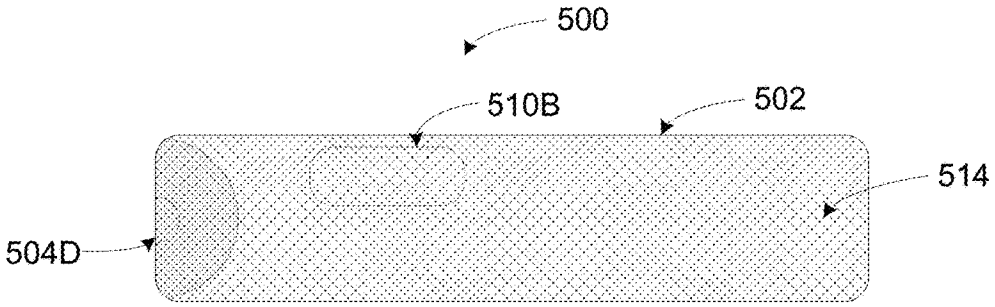
FIG. 5C shows a third view of the example playback device, according to example implementations.

Moving now to example implementations of techniques to reduce and/or avoid turbulence noise from a sound transducer mounted within an interior housing of a playback device, FIGS. 5A, 5B, and 5C show an example playback device 500. Playback device 500 represents a sound base type of playback device by way of example, but the example techniques are applicable to other types of playback devices as well. As noted above, in operation, a sound base may be paired with a display device (e.g., a television, such as a flat-panel LCD HDTV) to provide sound output for that display device. A sound base may reproduce sound from other sources as well. FIG. 5A shows a cut-away top view representation of an example playback device 500 while FIG. 5B and FIG. 5C show front view and side view representations of playback device 500, respectively.

As shown in FIG. 5A, mounted on or within a housing 502, playback device 500 includes audio drivers 504A, 504B, 504C, and 504D as well as audio driver 506 and audio drivers 508. Audio drivers 504A, 504B, 504C, and 504D represent mid-range (e.g., frequencies from approximately 250 to 2000 Hz, among other possible frequency ranges) or full-range audio transducers (e.g., transducers designed to reproduce a larger range of frequencies). Audio driver 506 represents a tweeter-type speaker designed to reproduce relatively high-frequency sounds (e.g., treble frequencies from approximately 2000 to 20,000 Hz, among other examples). Audio driver 508 represents a woofer-type speaker designed to reproduce relatively low-frequency sounds (e.g., bass frequencies, such as from 40 Hz to 500 Hz, among other possible ranges).

Together, audio drivers 504A, 504B, 504C, and 506D, audio driver 506, and audio driver 508 may be designed to reproduce sound across a full-range (e.g., the range of human hearing or some other range of desired output). While a three-way loudspeaker system is shown by way of example, other implementations contemplated herein may include different numbers or types of audio drivers. For instance, another implementation may utilize a two-way speaker system, among other examples.

As shown in FIGS. 5A and 5B, audio drivers 504A, 504B, 504C, and 504D, and 506 are mounted on or near a front surface of the housing 502 to direct sound into the listening environment (e.g., a room of a home or business). In particular, audio drivers 504B, 504C, and 506 are mounted facing outward along the front side of the housing 502 to direct sound output forward (e.g., at seating within the listening environment). Audio drivers 504A and 504D are arranged at 45 degree angles at the front corners of the housing 502. Arranging drivers at such angles may produce a wider sound stage. In some implementations, audio drivers 504A, 504B, 504C, 504D may operate independently or in concert to reproduce multiple audio channels (e.g., stereo or surround sound recordings).

In contrast to audio drivers 504A, 504B, 504C, and 506D, audio driver 508 is mounted within an interior of the housing 502, as shown in FIG. 5A. In particular, audio driver 508 is mounted such that the transducer moves upward and downward along a vertical axis to produce sound output. In such an orientation, audio driver 508 is not directed toward the expected location of listeners. Conversely, audio drivers 504A, 504B, 504C, 504D, and 506 are mounted such that the respective transducers move along a horizontal axis to direct sound output toward into the listening environment.

Since they reproduce relatively higher frequencies, tweeters and mid-range audio drivers are relatively more directional as compared with woofers. As such, orienting these types of drivers at the expected listener locations may improve apparent sound quality to listeners in those locations. Bass frequencies are relatively less directional, so directing a woofer away from expected listener locations may have less effect on the overall bass response perceived by listeners as compared with drivers designed to reproduce higher frequencies. While this configuration of audio driver is shown by way of example, example implementations may include audio drivers in different combinations of horizontal and vertical mounting or at angles relative to the horizontal and/or vertical.

Some commercially-available speakers or playback devices have vertically-oriented audio transducers. For instance, some subwoofers have downward-firing transducers. Subwoofer transducers are often mounted on a bottom surface of the housing to direct exhaust at the floor rather than within an interior volume. Subwoofer transducers often have large diameter diaphragms (e.g., 8" to 12" or greater) that generate significant airflow in operation.

When mounted within the interior of the housing 502, audio driver 508 may divide a first interior volume and a second interior volume of the housing 502. For instance, a diaphragm of audio driver 508 forms part of the first interior volume. The housing 502 may forms the remainder of the first interior volume, perhaps in combination with other interior components, such as a mounting bracket. The rear of the diaphragm may form part of the second interior volume with some components of the woofer 508 (e.g., a magnet and voice coil) extending into that volume. As with the first interior volume, the housing 502 forms the remainder of the second interior volume, perhaps in combination with other interior components.

In operation, the voice coil and magnet of audio driver 508 may cause the diaphragm of audio driver 508 to produce significant exhaust (airflow) within the first interior volume and the second interior volume in order to produce the intended response at sufficient volume. To facilitate airflow from the first interior volume to the listening environment, playback device 500 includes vents 510A and 510B. As shown in FIGS. 5B and 5C, vents 510A and 510B provide respective airflow paths to the exterior of the housing 502 through a grill 514. Other implementations may include different types or combinations of openings for airflow.

Playback device 502 also includes a port 512 to the exterior of the housing 502. Port 512 facilitates airflow from the second interior volume to the listening environment. Such airflow may provide a cooling effect on the woofer 508 (and possibly other interior components). Port 512 may be tuned to resonate at certain frequencies, which may increase the bass response of woofer 508 at certain frequencies. Other implementations might not have an opening to facilitate airflow from the second interior volume to the listening environment (e.g., a sealed woofer design).

Various components of playback device 500 may constrain the size and location of audio driver 508 as well as any vents providing paths for airflow to the exterior of housing 502. For instance, speakers audio drivers 504A, 504B, 504C, 504D, and 506 may be mounted in particular locations, leaving those locations unavailable for venting. Other components not shown in FIG. 5, such as a processor, memory, audio processing components, audio amplifier(s), and input/output interfaces, among other examples, may also constrain the geometry. Moreover, other considerations may constrain the overall geometry of the housing 502. For instance, consumer preferences for certain geometries (e.g., smaller and/or sleeker devices) and geometric compatibility with other devices (e.g., commercial available televisions) may limit the length, width, or height of the housing 502 as well as the total volume.

Given such constraints, some playback devices might not have enough interior space and/or exterior surface to include a vent with a large enough cross-section. A vent that is not large enough will cause exhaust from the woofer to exit at high velocity and create audible noise from turbulence. Such noise may affect enjoyment of audio from the playback device.

As such, some example playback devices may include multiple vents to increase the total cross section of openings to the exterior for exhaust from the interior audio driver(s). For instance, playback device 502 includes vents 510A and 510B. Given that the geometries of vents 510A and 510B are each constrained, including multiple vents in playback device 500 increases the overall cross-section of openings for exhaust from audio driver out to the listening environment. As such, overall noise from turbulence is reduced.

In some implementations with multiple vents, one or more first vents are formed to direct more-directional higher velocity noise away from expected listener locations (e.g., to the side) and one or more second vents are formed to handle less-directional lower velocity noise. The second vents may direct such noise toward expected listener locations (e.g., out the front), as the less-directional lower velocity noise is less noticeable.

More particularly, by controlling the cross-sectional area of each vent relative to the others, the airspeed through each vent can be controlled. Since noise from turbulence is proportional to airspeed, controlling the cross-sectional area of each vent relative to the others also controls the "share-of-noise" that is generated by each vent. Moreover, most of the overall intensity of noise from turbulence tends high-frequency noise, which is relatively directional.

To direct the noise from turbulence to the side (and away from expected listener locations in front of the playback device), one or more relatively higher velocity vents are directed away from expected listener locations. For instance, vent 510B may have a relatively smaller cross section (and thus higher velocity airflow and more noise) as compared with vent 510A. In one particular implementation, vent 510B may carry air at 3× the velocity of vent 510A. As such, approximately 75% of the noise from turbulence is directed through vent 510B. However, vent 510B directs this noise to the side of playback device 510. As a result, vent 510A directs less noise out into the listening area where listeners would be more likely to hear unwanted noise.

Although playback device 500 directs high velocity exhaust to the side, higher velocity vents may be directed in other directions in an attempt to avoid directing this exhaust at listeners. For instance, example higher velocity vents may direct sound upwards, downwards, backwards or even forwards, among other possible directions, in order to direct noise from turbulence away from expected listener locations. In a sound base like playback device 500, exhaust vented out the front and side(s) may be less likely to encounter obstructions relative to the upwards, downwards, or backwards directions. Such directions may be more likely to have furniture, walls, or other devices (e.g., a television) in common use cases.

Exhaust vented into an obstruction may create more turbulence (and associated noise). For instance, playback devices (e.g., a sound base) may be commonly placed by users in close proximity to a wall. In implementations where woofer exhaust is directed out the rear of the device, the wall may create audible turbulence. In contrast, exhaust vented out the front and side(s) may be less likely to encounter an obstruction that creates turbulence.

Although, as noted above, playback device 500 is shown as having constrained geometry by way of example, other implementations might not have such constrained geometries. In such configurations, a single vent may have a large enough cross section to handle exhaust from an interior woofer without creating unacceptable noise. In such implementations, the vent may direct all of the exhaust away from the listening area.

However, including multiple vents may have possible benefits in addition to increasing the overall cross-section. For instance, in implementations where the vents are oriented in different directions around the woofer circumference (as with vents 510A and 510B), the arrangement of these vents may create more uniform pressure on the diaphragm of audio driver 508. More uniform pressure on the diaphragm may yield more uniform motion (radially and azimuthally) of the diaphragm, which may prevent acoustic distortion during operation as compared with some other vent arrangements (e.g., a single vent). As another example, in the event that furniture, walls, or another object obstructs a vent, the playback device includes another vent that can carry exhaust from the interior audio driver. As such, less distortion is created than if the obstructed vent(s) were the only pathway for exhaust.

In some implementations, where multiple vents handle exhaust from an interior audio driver, the multiple vents are positioned at a distance that is at less than the operation wavelength of the audio driver. For instance, the distance between vent 510A and 510B may be kept at ⅙ or less of the operational wavelength of audio driver 508. Such an arrangement may prevent or reduce harmonics.

As noted above, vents 510A and 510B directed exhaust from audio driver 508 through a grill 514. Grill 514 also covers audio drivers 504A, 504B, 504C, 504D, and 506, as shown in FIGS. 5A, 5B, and 5C. A grill over vents 510A and 510B may partially obstruct exhaust from audio driver 508 and thus create additional turbulence (and associated noise).

However, such a grill may enhance the aesthetic appearance of the playback device. In particular, a grill over the front of the device may contribute to the playback device looking sleeker or cleaner from the expected listener location, especially if the grill includes small perforations. Such attributes may be desirable to consumers. On the other hand, smaller perforations may create more of an obstruction to exhaust, thereby increasing turbulence.

In implementations that include one or more grills covering the vent(s), directing the high velocity (noisier) exhaust through vents covered with larger grill perforations may reduce noise from turbulence from the grill. Moreover, as noted above, some implementations may use vents with smaller cross sections to direct high velocity (noisier) away from expected user locations. Since such vents are pointed away from the expected listener locations, larger grill perforations covering such vents might not be visible from the expected user locations. Where a vent is directed toward expected listener locations (e.g., as with vent 510A), smaller grill perforations may cover this vent to enhance aesthetics. At the same time, such vents may have larger cross sections to lower exhaust velocity, so the smaller perforations do have as much of an effect relative to higher velocity exhaust.

In some particular implementations, a continuous (i.e., gapless) grill may cover the front and side(s) of the playback device. Perforation size across the continuous grill may vary. For instance, across the front of the device, the perforations may be small, to enhance aesthetics of the device. Along the sides, the perforations may be larger, to allow for higher velocity of exhaust to exit vents on one or more of the sides. The transition from small grill perforations to large perforations may be gradual across the grill, to avoid a quick (step) transition in hole size that may affect the aesthetic of the device.

Figure 6A:
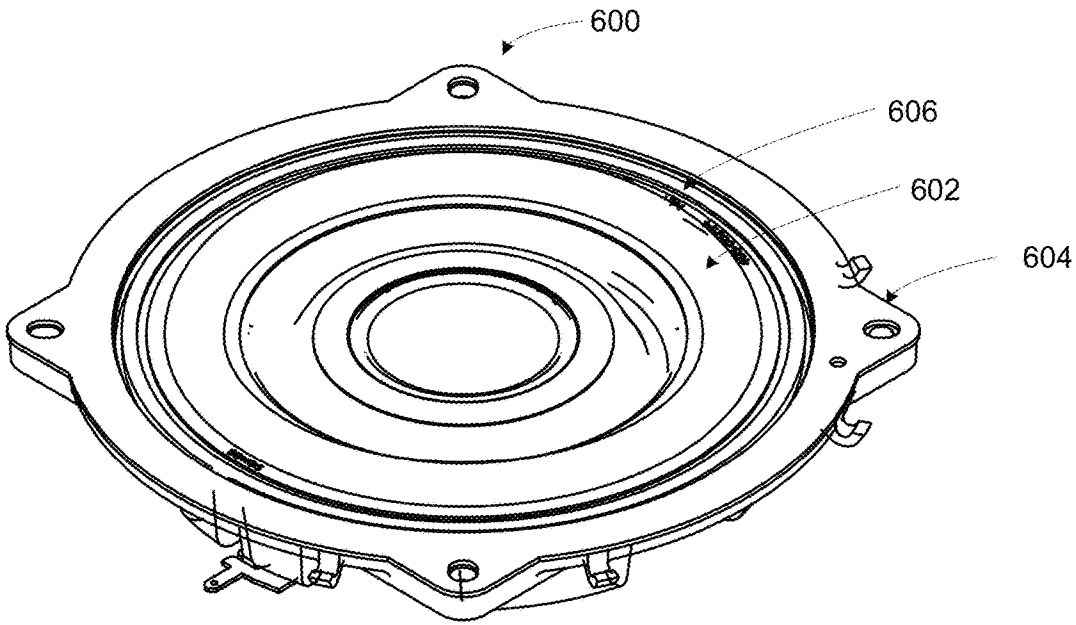
FIG. 6A shows a first view of an example audio driver, according to example implementations.
Figure 6B:
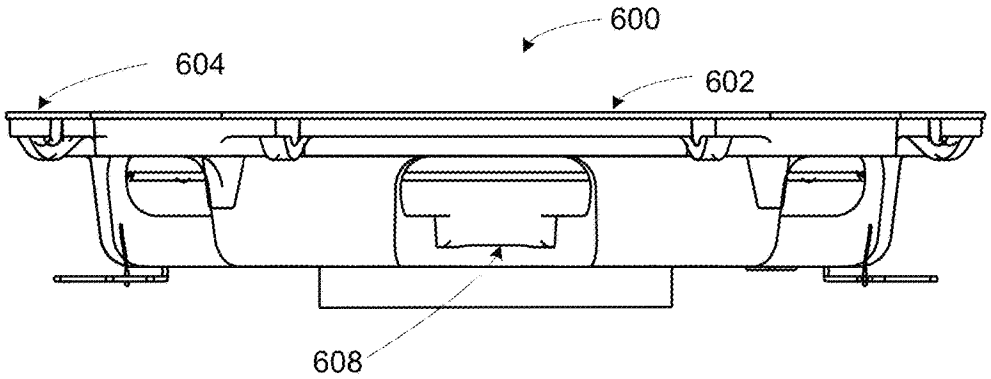
FIG. 6B shows a second view of the example audio driver, according to example implementations.

Moving now to an example audio driver, FIGS. 6A and 6B respectively show an isometric projection and a side view of a woofer 600. Woofer 600 is an example of a audio driver that is mountable within an interior of playback device, according to example implementations described herein. As shown in FIG. 5A, woofer 600 includes a diaphragm 602 (i.e., a cone), a frame 604, and suspension 606 connecting the diaphragm 602 to the frame 604. FIG. 5B additionally shows an assembly 608 that includes a magnet and voice coil to drive the diaphragm 602 during operation.

Figure 7:
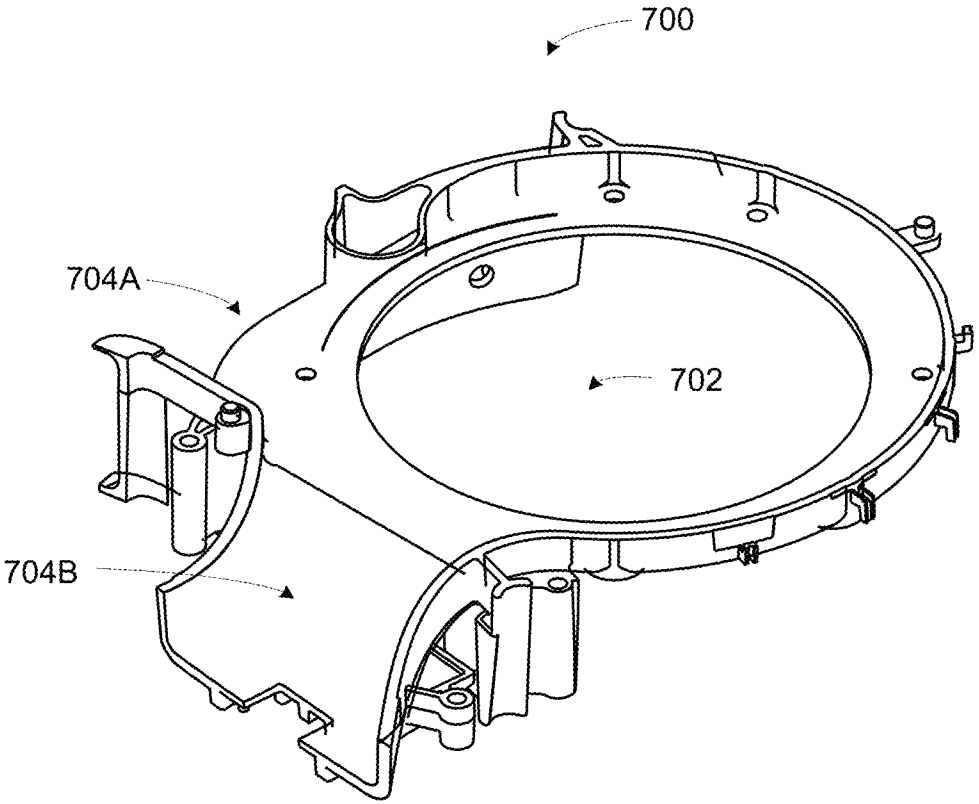
FIG. 7 shows an example mounting bracket, according to example implementations.

FIG. 7 shows a mounting bracket 700, which illustrates an example bracket for mounting of a woofer within the interior of a playback device. Mounting bracket 700 includes an opening 702 formed to hold an audio driver (e.g., woofer 600) for mounting. Mounting bracket 700 also partially forms vents 704A and 704B. When assembled into a playback device, a housing may form the rest of vents 704A and 704B, perhaps in combination with other components. During operation, exhaust from an audio driver mounted in opening 702 could be directed through vents 704A and 704B to the exterior of the playback device.

Figure 8:
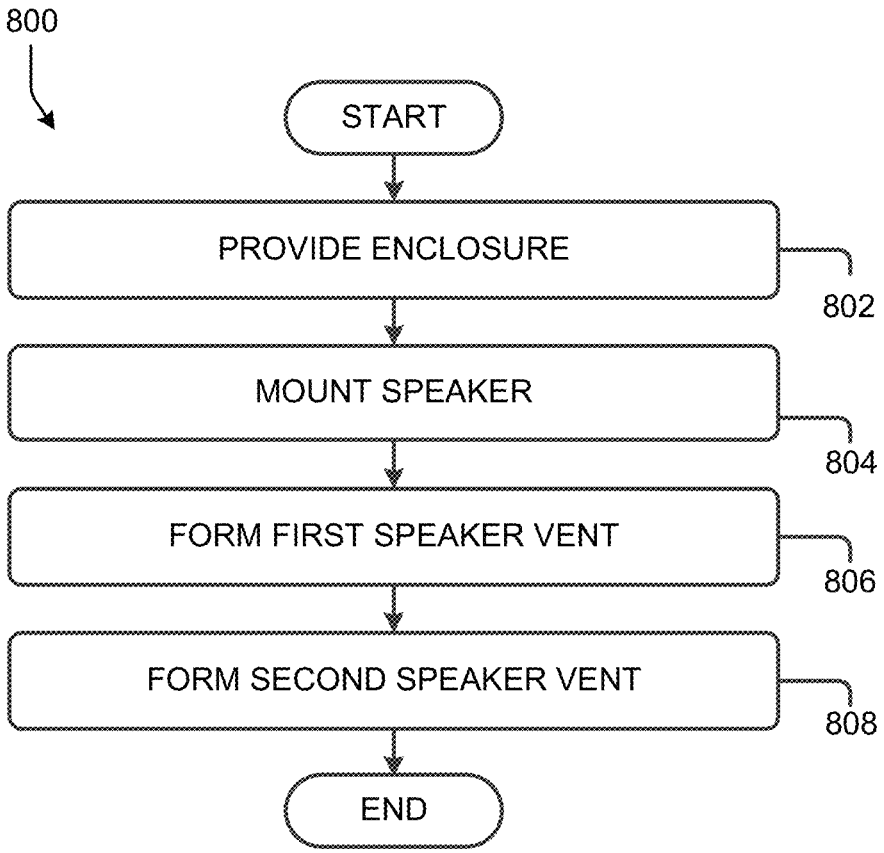
FIG. 8 shows a technique to assemble a playback device, according to example implementations.

Implementation 800 shown in FIG. 8 presents example embodiments of a technique to provide a playback device according to examples described herein. At block 802, implementation 800 involves providing an enclosure that includes a first interior volume and a second interior volume. At block 804, implementation 800 involves mounting a speaker within an interior of the enclosure. When mounted, the speaker is moveable along an axis to generate sound. A diaphragm of the speaker may divide the first interior volume and the second interior volume. Moving now to block 806, implementation 800 involves forming a first speaker vent providing airflow between the first interior volume and an exterior of the enclosure. The first speaker vent may directs airflow in a first direction. At block 808, implementation 800 involves forming a second speaker vent providing airflow between the first interior volume and the exterior of the enclosure. The second speaker vent may directs airflow in a second direction that is substantially at an angle (e.g., perpendicular) to the axis.

Similar to some embodiments disclosed herein, a bandpass woofer enclosure includes an interior mounted woofer. With a bandpass woofer enclosure, the woofer plays into an interior volume and the sound output is produced through a port from that interior volume to the exterior of the bandpass woofer enclosure. Compared to certain implementations described herein as having constrained dimensions, the interior volume of the bandpass woofer enclosure is much larger, so as to provide the benefit of increasing the bass energy in a certain band (e.g., from 100-200 Hz).

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

(Feature 1) A playback device comprising an enclosure comprising a first interior volume and a second interior volume; a speaker mounted within an interior of the enclosure and comprising a diaphragm dividing the first interior volume and the second interior volume, wherein the speaker is moveable along an axis to generate sound; a first speaker vent providing airflow between the first interior volume and an exterior of the enclosure, wherein first speaker vent directs airflow in a first direction that is substantially perpendicular to the axis; and a second speaker vent providing airflow between the first interior volume and the exterior of the enclosure, wherein second speaker vent directs airflow in a second direction that is substantially perpendicular to the axis.

(Feature 2) The playback device of any preceding feature, wherein the axis is vertical and the first direction and second direction are horizontal.

(Feature 3) The playback device of any preceding feature, wherein the enclosure comprises a front surface and a side surface that is substantially perpendicular to the front surface, and wherein the first speaker vent provides airflow between the first interior volume and the front surface of the enclosure and the second speaker vent provides airflow between the first interior volume and the side surface of the enclosure.

(Feature 4) The playback device of any preceding feature, wherein the second speaker vent has a smaller cross section than the first speaker vent such that the second speaker vent provides a higher velocity of airflow than the first speaker vent.

(Feature 5) The playback device of any preceding feature, wherein the front surface comprises a first speaker grille between the first speaker vent and the exterior of the enclosure, and wherein the side surface comprises a second speaker grille between the first speaker vent and the exterior of the enclosure.

(Feature 6) The playback device of any preceding feature, wherein the first speaker grille comprises first perforations on the front surface of the enclosure and the second speaker grille comprise second perforations on the side surface of the enclosure, the second perforations being larger than the first perforations such that the second speaker grille is less resistant to airflow than the first speaker grille.

(Feature 7) The playback device of any preceding feature, wherein the enclosure comprises a front surface and a side surface that is substantially perpendicular to the front surface, and wherein the side surface comprises (i) a first speaker grille between the first speaker vent and the exterior of the enclosure and (ii) a second speaker grille between the second speaker vent and the exterior of the enclosure.

(Feature 8) The playback device of any preceding feature, wherein the first speaker vent and the second speaker vent are separated by a distance that is less than an operational wavelength of the speaker.

(Feature 9) The playback device of any preceding feature, wherein the first horizontal direction and the second horizontal direction are at a relatives angle to one another that is within a range of 90° to 180°.

(Feature 10) The playback device of any preceding feature, wherein the playback device further comprises one or more tweeters facing outwards along a front surface of the enclosure that operate in a frequency range of at least 2000-20000 Hz.

(Feature 11) The playback device of any preceding feature, wherein the first horizontal direction is the same as the second horizontal direction.

(Feature 12) The playback device of any preceding feature, further comprising a speaker port tube coupling the second interior volume to the exterior of the enclosure.

(Feature 13) A method to assemble the playback device of any of features 1-12.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

The invention claimed is:

1. A playback device comprising:

an enclosure defining an interior portion including a first interior volume and a second interior volume, wherein each horizontal dimension of the enclosure is longer than a vertical dimension of the enclosure, the enclosure comprising:

a front surface having a first horizontal dimension and a vertical dimension; and a side surface having a second horizontal dimension and the vertical dimension, a speaker disposed within the interior portion of the enclosure and comprising a diaphragm dividing the first interior volume and the second interior volume, and wherein each dimension of a horizontal cross-section of the diaphragm is longer than the vertical dimension of the front surface and the side surface;

a first speaker vent in the front surface having a first cross-sectional area, wherein the first speaker vent is configured to direct a first airflow from the first interior volume to an exterior of the enclosure in a first direction; and a second speaker vent in the side surface having a second cross-sectional area, wherein the second speaker vent is configured to direct a second airflow from the first interior volume to the exterior of the enclosure in a second direction; and wherein the second speaker vent has a smaller cross section than the first speaker vent.

2. The playback device of claim 1, wherein the horizontal cross-section of the diaphragm is a circular horizontal cross-section, and wherein a diameter of the circular horizontal cross-section is longer than the vertical dimension of the enclosure.

3. The playback device of claim 1, wherein the first direction is towards an expected listener location, and wherein the second direction is away from the expected listener location.

4. The playback device of claim 1, wherein the speaker is a woofer, wherein the playback device further comprises one or more mid-range drivers having respective diaphragms smaller than the diaphragm of the woofer, and wherein at least one first mid-range driver is disposed perpendicular to the woofer to face outwards along the front surface of the enclosure.

5. The playback device of claim 4, wherein at least two second mid-range drivers are disposed perpendicular to the woofer to face outwards at respective 45 degree angles to the at least one first mid-range driver.

6. The playback device of claim 1, wherein the speaker is a woofer, wherein the playback device further comprises one or more tweeters having respective membranes smaller than the diaphragm of the woofer, and wherein at least one first tweeter is disposed perpendicular to the woofer to face outwards along the front surface of the enclosure.

7. The playback device of claim 1, further comprising a speaker port tube coupling the second interior volume to the exterior of the enclosure.

8. The playback device of claim 1, wherein the front surface comprises a first speaker grille between the first speaker vent and the exterior of the enclosure, wherein the first speaker grille comprises first perforations on the front surface of the enclosure, wherein the side surface comprises a second speaker grille between the second speaker vent and the exterior of the enclosure, and wherein the second speaker grille comprises second perforations on the side surface of the enclosure, the second perforations being larger than the first perforations such that the second speaker grille is less resistant to airflow than the first speaker grille.

9. The playback device of claim 8, wherein the playback device comprises a continuous grille comprising the first speaker grille and the second speaker grille.

10. The playback device of claim 9, wherein perforations in the continuous grille gradually increase in size along the front surface of the enclosure to the side surface of the enclosure.

11. The playback device of claim 1, wherein the speaker is mounted horizontally such that a voice coil of the speaker drives the diaphragm along a vertical axis to generate sound when the enclosure is placed upon a horizontal surface.

12. An enclosure of a playback device, each horizontal dimension of the enclosure being longer than a vertical dimension of the enclosure, the enclosure comprising:

a front surface having a first horizontal dimension and a vertical dimension;

a side surface having a second horizontal dimension and the vertical dimension;

an interior portion defined by the enclosure, the interior portion of the enclosure defining an interior portion including a first interior volume and a second interior volume, one or more interior surfaces defining an opening to dispose a speaker within the interior portion of the enclosure such that a diaphragm of the speaker divides the first interior volume and the second interior volume, and wherein each dimension of a horizontal cross-section of the diaphragm is longer than the vertical dimension of the enclosure;

a first speaker vent in the front surface having a first cross-sectional area, wherein the first speaker vent is configured to direct a first airflow from the first interior volume to an exterior of the enclosure in a first direction; and a second speaker vent in the side surface having a second cross-sectional area, wherein the second speaker vent is configured to direct a second airflow from the first interior volume to the exterior of the enclosure in a second direction; and wherein the second speaker vent has a smaller cross section than the first speaker vent.

13. The enclosure of claim 12, wherein the speaker is a woofer, wherein the enclosure further defines one or more openings to dispose one or more mid-range drivers perpendicular to the woofer to face outwards along the front surface of the enclosure, wherein the one or more mid-range drivers have respective diaphragms smaller than the diaphragm of the woofer.

14. The enclosure of claim 12, wherein the speaker is a woofer, wherein the playback device further defines one or more openings to dispose one or more tweeters perpendicular to the woofer to face outwards along the front surface of the enclosure, wherein the one or more tweeters have respective membranes smaller than the diaphragm of the woofer.

15. The enclosure of claim 12, wherein the enclosure defines an interior speaker port tube coupling the second interior volume to the exterior of the enclosure.

16. The enclosure of claim 12, wherein the front surface comprises a first speaker grille between the first speaker vent and the exterior of the enclosure, wherein the first speaker grille comprises first perforations on the front surface of the enclosure, wherein the side surface comprises a second speaker grille between the second speaker vent and the exterior of the enclosure, and wherein the second speaker grille comprises second perforations on the side surface of the enclosure, the second perforations being larger than the first perforations such that the second speaker grille is less resistant to airflow than the first speaker grille.

17. The enclosure of claim 16, wherein the playback device comprises a continuous grille comprising the first speaker grille and the second speaker grille.

18. The enclosure of claim 17, wherein perforations in the continuous grille gradually increase in size along the front surface of the enclosure to the side surface of the enclosure.

19. The enclosure of claim 12, wherein the first direction is towards an expected listener location, and wherein the second direction is away from the expected listener location.

20. A method of assembling a playback device, the method comprising:

providing an enclosure defining an interior portion including a first interior volume and a second interior volume, wherein each horizontal dimension of the enclosure is longer than a vertical dimension of the enclosure, the enclosure comprising:

a front surface having a first horizontal dimension and a vertical dimension; and a side surface having a second horizontal dimension and the vertical dimension, disposing a speaker within the interior portion of the enclosure and comprising a diaphragm dividing the first interior volume and the second interior volume, and wherein each dimension of a horizontal cross-section of the diaphragm is longer than the vertical dimension of the front surface and the side surface;

forming a first speaker vent in the front surface having a first cross-sectional area, wherein the first speaker vent is configured to direct a first airflow from the first interior volume to an exterior of the enclosure in a first direction; and forming a second speaker vent in the side surface having a second cross-sectional area, wherein the second speaker vent is configured to direct a second airflow from the first interior volume to the exterior of the enclosure in a second direction; and wherein the second speaker vent has a smaller cross section than the first speaker vent.

* * * * *